US005480168A

United States Patent [19]

Chen

[11] Patent Number: 5,480,168

[45] Date of Patent: Jan. 2, 1996

[54] QUICK ADJUSTABLE FASTENING MEANS TO ADJUST THE POSITION OF A GAITER ON A ROLLER SKATE

[75] Inventor: Ting-Hsing Chen, Tainan, Taiwan

[73] Assignee: Far Great Plastics Industrial Co., Ltd., Tainan, Taiwan

[21] Appl. No.: 375,665

[22] Filed: Jan. 20, 1995

[30] Foreign Application Priority Data

Jan. 9, 1995 [CN] China ..... 95200919.6

[51] Int. Cl.[6] ..... A63C 17/06

[52] U.S. Cl. ..... 280/11.22; 36/115

[58] Field of Search ..... 280/11.19, 11.22, 280/11.23, 809, 811, 11.3; 36/45, 91, 115, 121

[56] References Cited

U.S. PATENT DOCUMENTS

| | | | |
|---|---|---|---|
| 4,126,323 | 11/1978 | Scherz | 36/115 X |
| 4,473,235 | 9/1984 | Burt | 36/121 X |
| 4,601,118 | 7/1986 | Zanatta | 36/121 X |
| 4,844,491 | 7/1989 | Wheelwright | 280/11.3 X |
| 5,381,613 | 1/1995 | Pozzobon et al. | 36/121 X |
| 5,397,141 | 3/1995 | Hoshizaki et al. | 280/11.22 X |

*Primary Examiner*—Brian L. Johnson

*Attorney, Agent, or Firm*—Morton J. Rosenberg; David I. Klein

[57] ABSTRACT

A quick adjustable fastening system for adjusting the position of a gaiter with respect to a roller skate is provided. The system includes a roller skate having a pair of troughs at each respective side of a back portion thereof and a gaiter having a pair of bulge portions at respective sides through which a centrally disposed aperture is formed. Each trough includes at least two apertures between which is formed a slotted opening which is sized smaller than that of the two apertures. A rod member is provided having a plurality of longitudinal slots formed in a front section, an enlarged portion at one end, and a head at the opposing other end. The aperture of the trough has an inner diameter smaller than that of the enlarged portion of the rod member, but slightly larger than that of the front section. A rear section which is defined as being between the front section and the head has an outer diameter slightly smaller than that of the slot. The rod member secures the gaiter to the roller skate when the front section of the rod member is located in the aperture of the trough. The gaiter is slidably adjustable with respect to the roller skate when front section of the rod member has been displaced from the aperture of the trough.

1 Claim, 4 Drawing Sheets

QUICK ADJUSTABLE FASTENING MEANS TO ADJUST THE POSITION OF A GAITER ON A ROLLER SKATE

BACKGROUND OF THE INVENTION

FIELD OF THE INVENTION

This invention relates to a fastening means and more particularly to a quick adjustable fastening means to adjust the position of a gaiter on a roller skate.

In one prior art system, the fastening means for securing a gaiter to a roller skate or the like provides a buckle which is inserted on the gaiter through one of two or three holes on the roller skate. Each different hole represents a different position of the gaiter with respect to the roller skate. To adjust the position of the gaiter, the buckle should be pulled out from one hole and pushed into another appropriate hole. However, these pulling out and pushing in steps will not only take the skater's time, but also wear out the parts. Another known fastening means includes a buckle integrally formed on the back portion of a roller skate, extending outwardly from one of two holes on a gaiter. A belt is also provided having one end secured to a fastener on the gaiter. The other end of the belt is wrapped around the gaiter and passes through the buckle and is then fastened by the fastener. The holes of the gaiter are adapted to adjust the position of the gaiter with respect to the skate. Therefore the adjustment requires the buckle to be pulled out from the hole and inserted into another hole, which is inconvenient to use.

SUMMARY OF THE INVENTION

It is the primary object of the present invention to provide a quick adjustable fastening system which utilizes a pair of rods to slide in two longitudinal troughs to adjust the position of the gaiter.

It is another object of the present invention to provide a quick adjustable fastening system which is easy to operate.

It is a further object of the present invention to provide a quick adjustable fastening system to adjust the position of a gaiter to a roller skate which is inexpensive to manufacture.

DETAILED DESCRIPTION OF THE PREFERRED EMBODIMENTS

Figure 1:
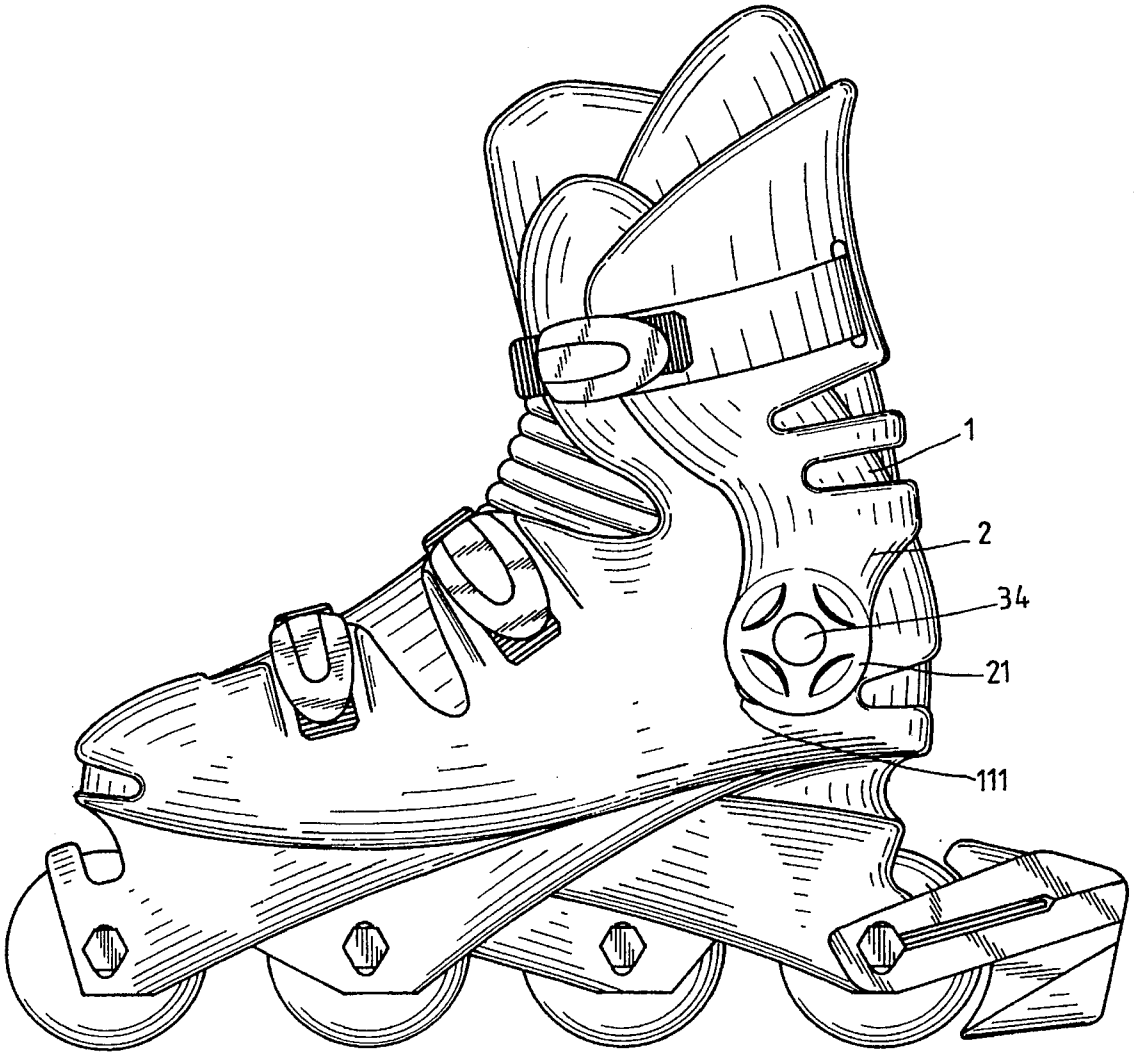
FIG. 1 is a perspective view of a roller skate having incorporated therein the quick adjustable fastening system of the present invention.
Figure 2:
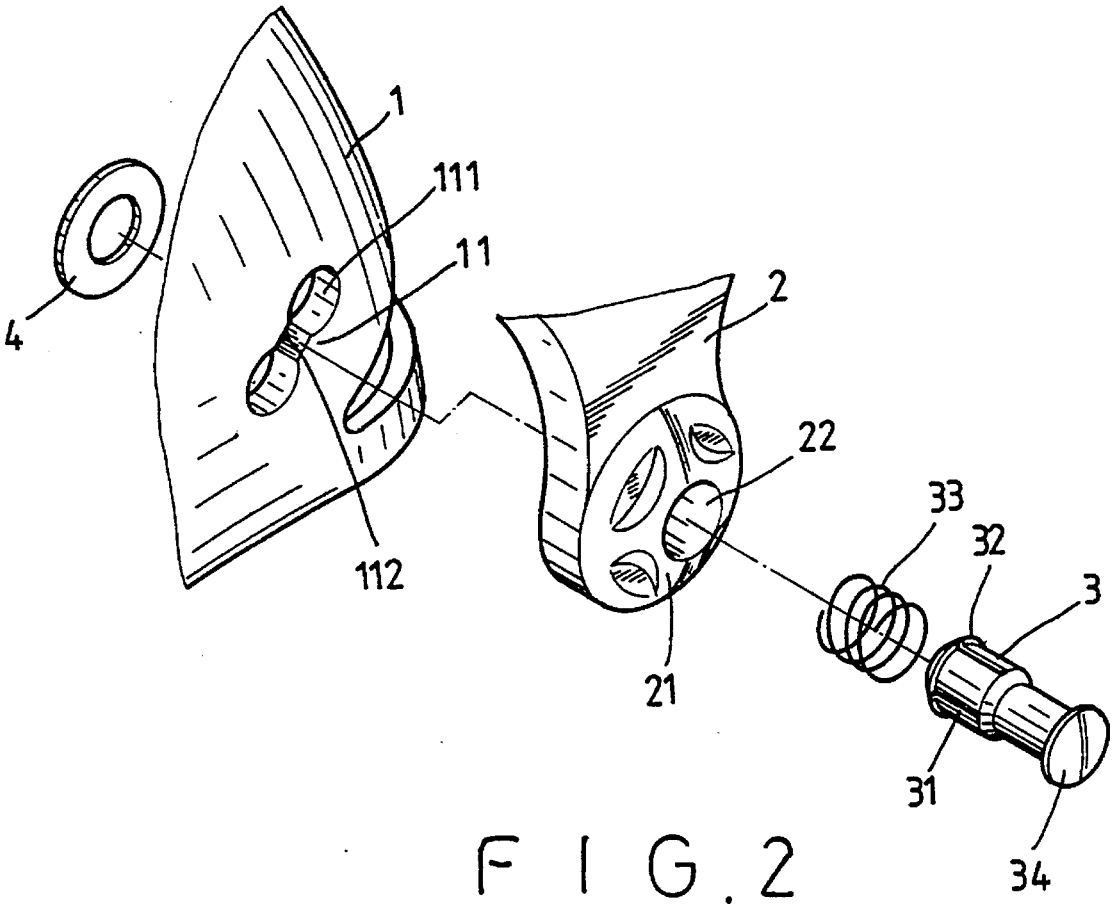
FIG. 2 is an exploded view of the present invention.

Referring now to FIGS. 1 through 5, there is shown a quick adjustable fastening means for the purpose of illustrating the preferred embodiments only and not for the purpose of limiting the inventive concept illustrated therein. FIGS. 1 and 2 include a roller skate 1, a gaiter 2, a rod member 3, and washers 4 forming the present invention.

The roller skate 1 includes a pair of troughs 11 at respective sides of rear end thereof (only one side is shown). Each trough 11 includes two apertures 111 communicated therebetween by a slot 112. The slot 112 has a smaller diameter with respect to the apertures 111.

The gaiter 2 includes a pair of bulge portions 21 at respective sides thereof. Each bulge portion 21 has an aperture 22 formed at a center portion thereof coinciding in position with the aperture 111 of the trough 11. The aperture 22 is sized to have several different diameters, and having a smallest diameter portion disposed at an inner end and a largest diameter portion at the outer end thereof. The smallest diameter, at the inner end, is slightly larger than the diameter of the aperture 111.

The rod member 3 includes an enlarged end portion 32 formed at one end thereof, a plurality of longitudinal slots 31 formed in a half section adjacent the enlarged end portion, the half section being defined as a front section, and a head 34 formed at the other end, opposite the enlarged end portion 32. The enlarged portion 32 has a diameter larger than that of the aperture 111. The front section of the rod member 3 has a diameter equal to the diameter of the aperture 111. A rear section which is defined as being between the front section and the head 34 has a diameter smaller than that of the front section and smaller than that of the slot 112. The head 34 has a diameter equal to the inner diameter of the end portion of the aperture 22.

To assemble the present invention, a spring 33 is sleeved onto the rear section of the rod member 3. The rod member 3 is inserted into the aperture 22 with the enlarged portion 33 passing through the aperture 22 and the aperture 111 and secured by the washer 4 at the other end thereof. The spring 33 will have one end seated on the outer portion of the aperture 111 and the other end engaged with the inner end of the head 34, for biasing the head 34 outward.

Figure 3:
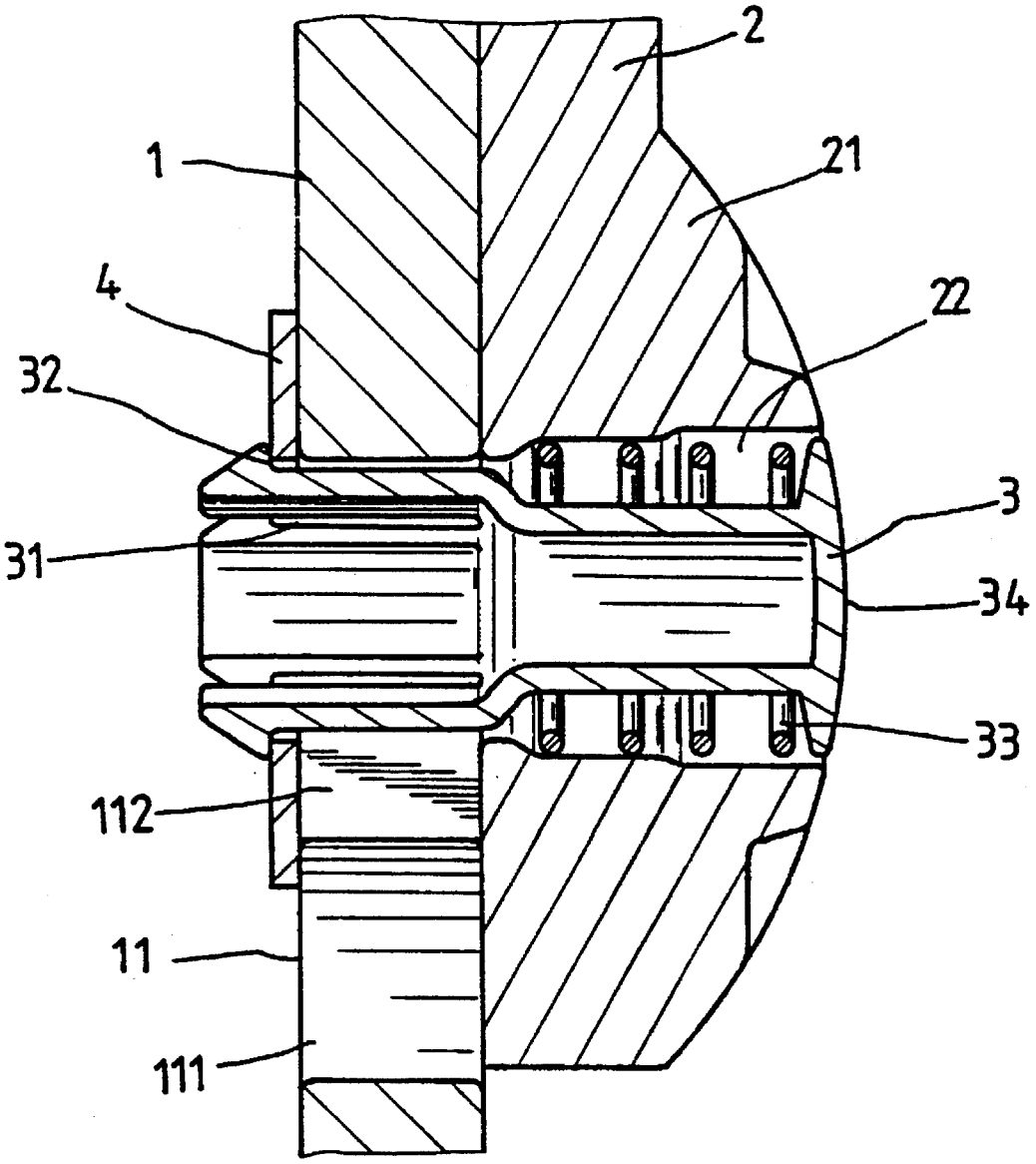
FIG. 3 is a cross-sectional view of the present invention in a roller skate.
Figure 4:
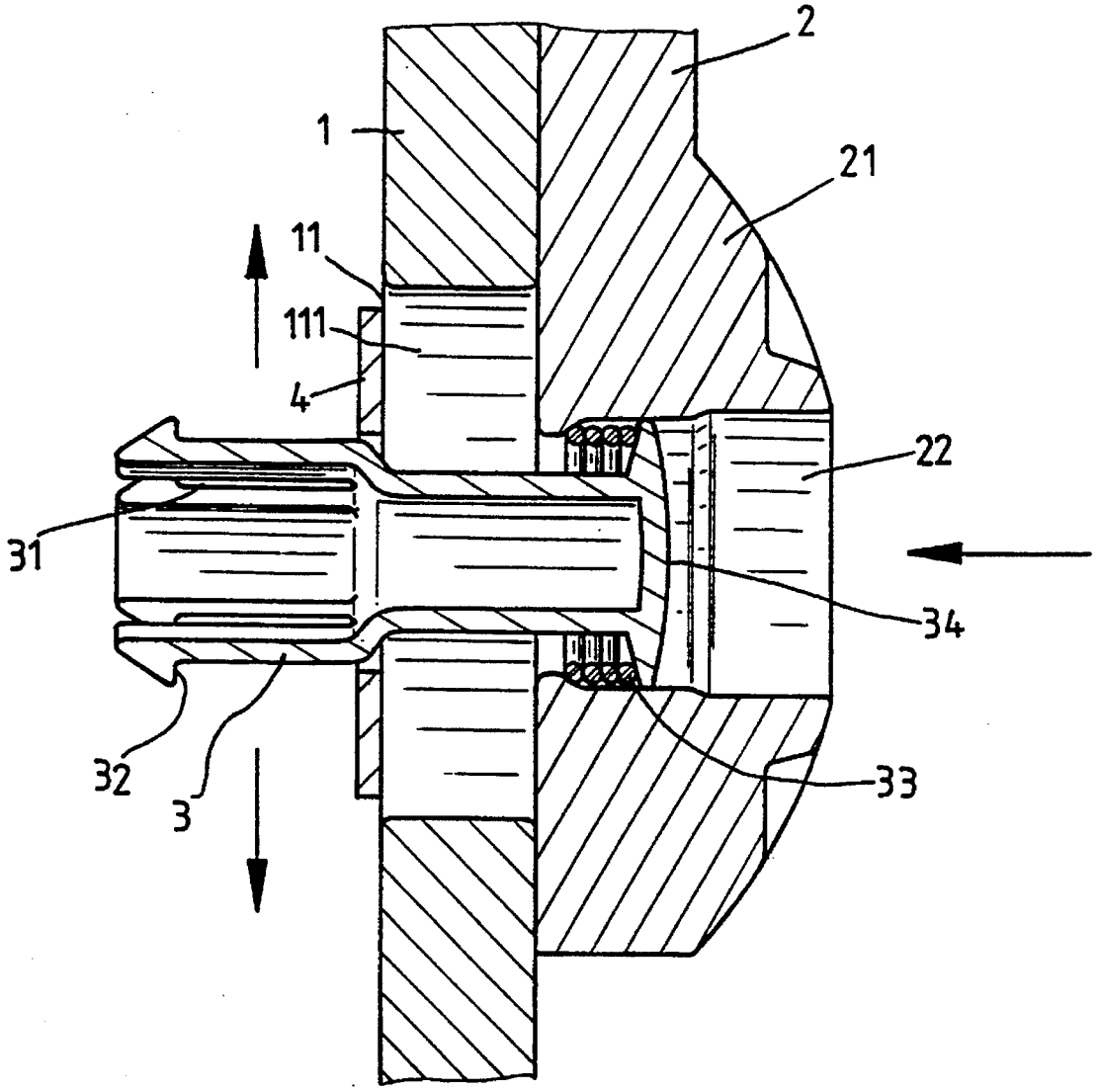
FIG. 4 is a cross-sectional view showing an operating condition of the present invention; and, FIG. 5 is a perspective view of a second embodiment of the present invention.

To operate the present invention, the head 34 is pressed inwardly, which urges the spring 33 and the rod member 3 inwardly. Once the front section of the rod member 3 has passed from the aperture 111, and the rear section has passed into the aperture 111, as shown in FIG. 4, the rod member 3 is slidable along the slot 112 as is the gaiter 2 simultaneously therewith. Thus the position of the gaiter 2 with respect to the skate 1 is adjustable. Upon release of the rod member 3, the spring 33 will urge the rod member 3 to return to its original position which brings the front section of the rod member 3 back into the aperture 111. Thus, the rod member 3 will be confined in the position, as shown in FIG. 3, as will the gaiter 2.

Figure 5:
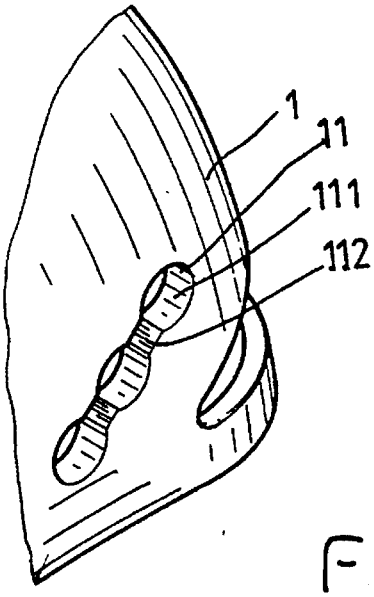

Another embodiment Of the present invention, shown in FIG. 5, provides more apertures 111 and respective slots 112 therebetween. These additional apertures 111 provide more options for skaters to adjust their gaiter.

I claim:

1. A quick adjustable fastening system to adjust the position of a gaiter with respect to a roller skate, comprising:

a roller skate having a pair of troughs formed through respective opposing sides thereof adjacent a rear end portion of said roller skate, each of said troughs being formed by at least two apertures and a slotted through opening therebetween, said slotted through opening having a width dimension smaller than a diameter dimension of said apertures;

a gaiter having a pair of bulge portions disposed on respective sides thereof, each of said bulge portions including a through bore formed in a center portion thereof and coinciding in position with a selected one of said apertures of said trough, said through bore having a first diameter at an inner end portion and a second diameter at an outer end portion thereof, said first diameter being smaller than said second diameter;

a pair of rod members, each of said pair of rod members extending through a respective through bore of said gaiter and a selected aperture of a respective trough, each rod member having longitudinal slots formed through a front section thereof and an enlarged portion formed on an end of said rod member adjacent said front section, said enlarged portion having a diameter larger than that of said aperture of said trough of said roller skate, said rod member having a head formed at an end thereof opposing said enlarged portion, said rod member having a rear section disposed between said front section and said head, said rear section having a diameter substantially equal to said width dimension of said slotted through opening of said trough, said front section having a diameter slightly smaller than that of said aperture of said trough of said roller skate;

a pair of springs, each of said pair of springs being concentrically disposed on said rear section of a respective rod member for applying a bias force to said head thereof; and a pair of washers, each of said pair of washers being disposed within said shoe for capturing an enlarged portion of a respective rod member, said gaiter being displaceable responsive to displacement of each of said rod members from one of said apertures of said trough to another, said rod member being displaceable from one aperture of said trough to another responsive to depression of said rod member within said through bore to displace said rear section of said rod member into said trough aperture and sliding said rear section through said slotted through opening to said other trough aperture.

* * * * *